US006565326B2

(12) United States Patent
Horng et al.

(10) Patent No.: US 6,565,326 B2
(45) Date of Patent: May 20, 2003

(54) HEAT-DISSIPATING FAN STRUCTURE

(75) Inventors: Alex Horng, Kaohsiung (TW); Ching-Shen Hong, Kaohsiung (TW); Tso-Kuo Yin, Kaohsiung Hsien (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 76 days.

(21) Appl. No.: 09/964,641

(22) Filed: Sep. 28, 2001

(65) Prior Publication Data

US 2003/0063979 A1 Apr. 3, 2003

(51) Int. Cl.[7] ..... F04B 49/06
(52) U.S. Cl. ..... 417/44.1; 310/67 R
(58) Field of Search ..... 417/44.11, 354; 415/178, 177; 310/90, 91, 67 R, 59, 156; 165/80.3, 121; 318/254

(56) References Cited

U.S. PATENT DOCUMENTS 4,104,552 A * 8/1978 Tsergas ..... 310/156
4,908,538 A * 3/1990 Geberth, Jr. ..... 310/59
5,582,506 A * 12/1996 Hong ..... 415/177
6,053,242 A * 4/2000 Hsieh ..... 165/121
6,132,170 A * 10/2000 Horng ..... 415/178
6,285,146 B1 * 9/2001 Harlan ..... 318/254
6,315,031 B1 * 11/2001 Miyahara et al. ..... 165/80.3
6,392,372 B1 * 5/2002 Mays, II ..... 318/254
6,400,049 B1 * 6/2002 Lai ..... 310/67 R
6,498,412 B2 * 12/2002 Horng ..... 310/91
2001/0043869 A1 * 11/2001 Horng ..... 417/354
2002/0135247 A1 * 9/2002 Liao ..... 310/90

FOREIGN PATENT DOCUMENTS

JP 10243620 * 9/1998 ..... H02K/29/00

* cited by examiner

*Primary Examiner*—Teresa Walberg
*Assistant Examiner*—Leonid M Fastovsky
(74) *Attorney, Agent, or Firm*—Bacon & Thomas, PLLC

(57) ABSTRACT

A heat-dissipating fan structure comprises a frame having a through-hole. An air inlet and an air outlet are respectively defined in two ends of the through-hole. A support section is provided in an end of the through-hole and at least two sets of windings are engaged on the frame. An IC control member is mounted on the frame and electrically connected to the windings. A rotor comprises a shaft and plural blades, and a permanent ring magnet is mounted around the blades. An end of the shaft is rotatably received in the support section of the frame. A repulsive magnetic force is directly created between the permanent ring magnet and the windings of the frame to drive the rotor to turn.

10 Claims, 6 Drawing Sheets

HEAT-DISSIPATING FAN STRUCTURE

BACKGROUND OF THE INVENTION

1. Field of the Invention

The present invention relates to a heat-dissipating fan having a simplified structure and being capable of eliminating the magnetic resistance on the magnetically conductive path, thereby providing an improved rotational torque.

2. Description of the Related Art

FIG. 7 of the drawings illustrates a conventional heat-dissipating fan structure comprising a casing 90 having an axle seat 91 to which a stator bobbin 92 is mounted. The stator bobbin 92 comprises a winding 923 wound therearound, an upper pole plate 921, and a lower pole plate 922. Extended through the stator bobbin 92 is a metal axle tube 93 in which a bearing 94 is mounted for rotatably holding a shaft 96 of a rotor 95. A permanent magnet 97 is mounted to the rotor 95 and comprises a north pole and a south pole that cooperates with a magnetic force generated in the edge of the upper and the lower pole plates 921 and 922 for generating a repulsive force, thereby driving the rotor 95 to turn.

In such a conventional heat-dissipating fan structure, the stator bobbin 92 is complicated and thus troublesome to manufacture as it has a winding 923 wound between the upper pole plate 921 and the lower pole plate 923. In addition, since the stator uses a metal axle tube 93 to form a magnetically conductive path together with the upper pole plate 921 and the lower pole plate 922, magnetic resistance exists in the material per se, which, in turn, results in an increase in the overall magnetic resistance, and the rotational torque is adversely affected accordingly.

SUMMARY OF THE INVENTION

It is an object of the present invention to provide a heat-dissipating fan structure that has fewer elements and thus has a smaller volume for easy manufacture and processing.

Another object of the present invention is to provide a heat-dissipating fan structure that directly creates a mutual repulsive force between a magnetic field generated by the winding and the permanent magnet having a south pole and a north pole to thereby eliminate the magnetic resistance on the magnetically conductive path, thereby providing an improved rotational torque.

A heat-dissipating fan structure in accordance with the present invention comprises a frame having a through-hole. An air inlet and an air outlet are respectively defined in two ends of the through-hole. A support section is provided in an end of the through-hole and at least two sets of windings are engaged on the frame. An IC control means is mounted on the frame and electrically connected to the windings. A rotor comprises a shaft and plural blades, and a permanent ring magnet is mounted around the blades. An end of the shaft is rotatably received in the support section of the frame. A repulsive magnetic force is directly created between the permanent ring magnet and the windings of the frame to drive the rotor to turn.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Preferred embodiments in accordance with the present invention will now be described with reference to the accompanying drawings.

Figure 1:
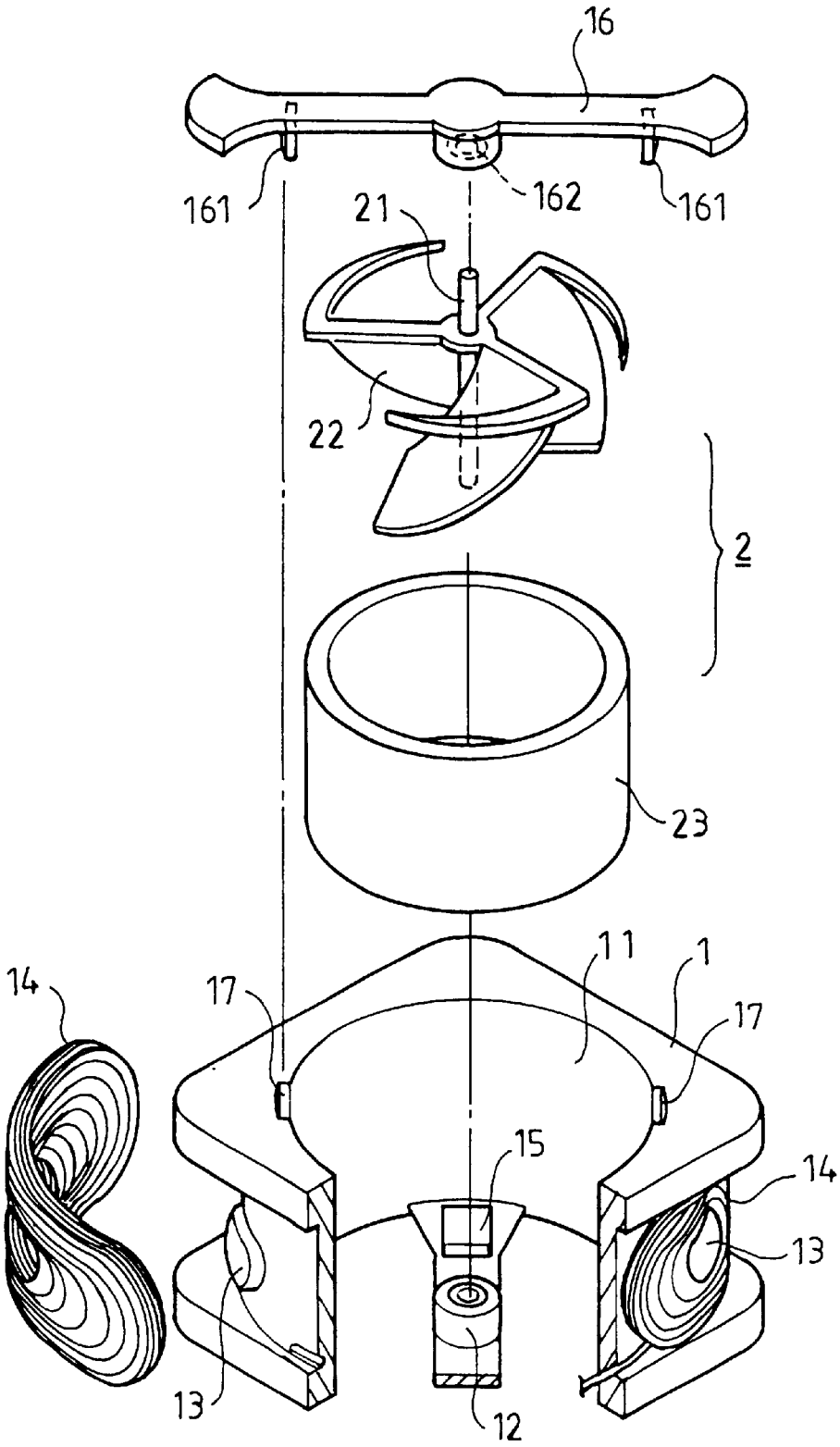
FIG. 1 is an exploded perspective view of a first embodiment of a heat-dissipating fan structure in accordance with the present invention.

Referring to FIG. 1, a first embodiment of a heat-dissipating fan structure in accordance with the present invention generally comprises a frame 2 and a rotor 2.

The frame 1 is a casing having a through-hole 11 for rotatably receiving the rotor 2. An air inlet is defined in an end of the through-hole 11 and an air outlet is defined in the other end of the through-hole 11. The frame 1 comprises a support section 12 on an end thereof, the support section 12 being in the form of a bearing or shaft sleeve for rotatably holding a shaft 21 of the rotor 2. At least two sets of windings 14 are engaged on the wall of the frame 1 and respectively secured on mounting members 13. The mounting members 13 may be formed on an inner face or an outer face of the wall of the frame 1. Alternatively, the mounting members 13 may be pegs projecting from the wall of the frame 1 for engaging with the windings 14. In order to allow the rotor 2 to turn, an IC control means 15 such as a conventional drive circuit or a Hall element is mounted on the frame 1, the IC control means 15 being electrically connected to the windings 14. In order to allow stable rotation of the rotor 2, a support element 16 is mounted on the other end of the frame 1. The support element 16 may be directly fixed on the frame 1. In a simple structure shown in FIG. 1, the support element 16 comprises engaging pieces 161 that are respectively engaged in positioning holes 17 in the frame 1. The support element 16 comprises a support section 162 in the form of a bearing or shaft sleeve.

The shaft 21 of the rotor 2 has plural blades 22 provided thereon and a permanent ring magnet 23 mounted to outer edges of the blades 22. Two ends of the shaft 2 are respectively, rotatably received in the support section 12 of the frame 1 and the support section 162 of the support element 16.

Figure 2:
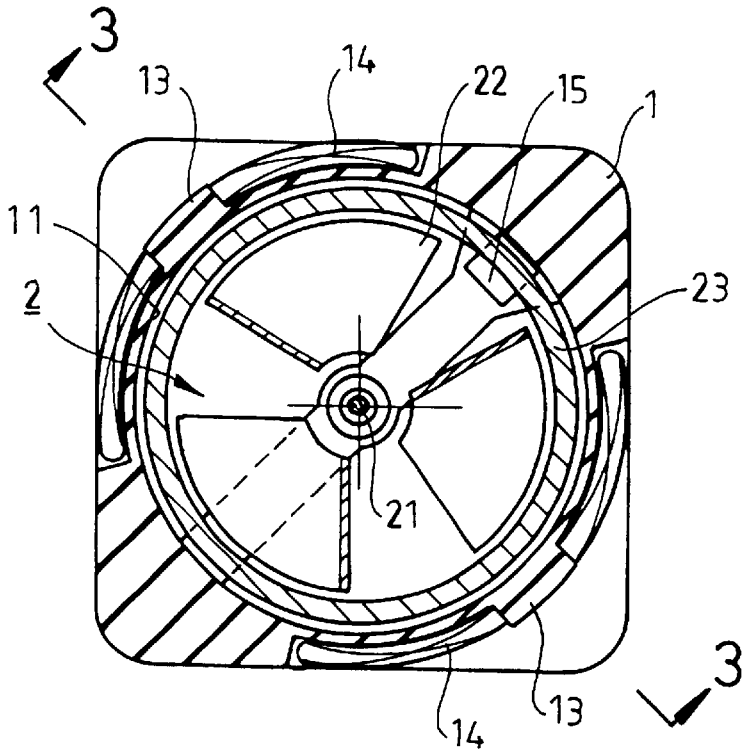
FIG. 2 is a sectional view of the heat-dissipating fan structure in FIG. 1.
Figure 3:
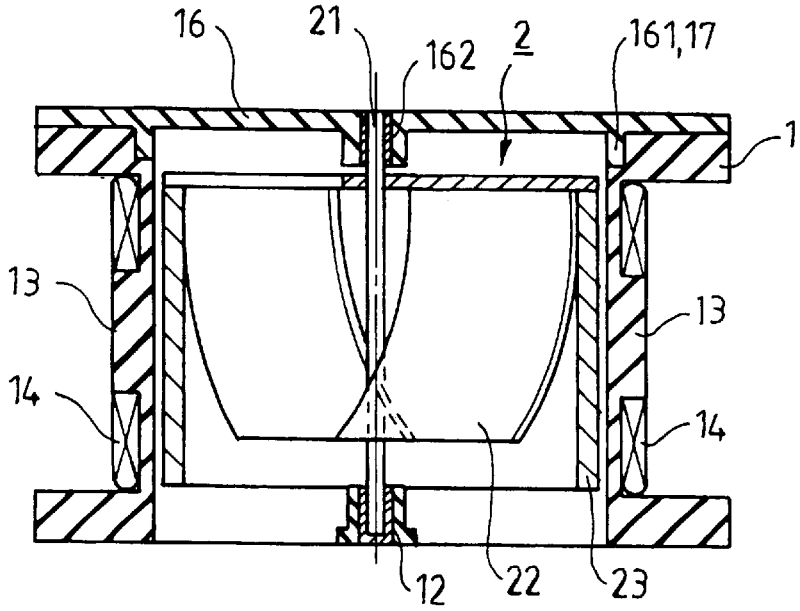
FIG. 3 is a sectional view taken along line 3—3 in FIG. 2.

As illustrated in FIGS. 2 and 3, the frame 1 has two mounting members 13 formed on the wall thereof for respectively engaging with two sets of windings 14. The rotor 2 is received in the through-hole 11 of the frame 1 with two ends of the shaft 21 of the rotor 2 respectively, rotatably received in the support section 12 of the frame 1 and the support section 162 of the support element 16 and with the permanent ring magnet 23 of the rotor 2 located corresponding to the positions of the windings 14. The IC control means 15 detects a change in the polarity of the permanent ring magnet 23 of the rotor 2 and sends a signal to alter the polarity of the magnetic field created by the sets of windings 14, thereby driving the permanent ring magnet 23 to turn by a repulsive force and thereby allowing continuous rotation of the rotor 2. At the same time, the blades 22 on the rotor 2 drive air to enter via an end of the through-hole 11 and to exit via the other end of the through-hole 11, thereby forming a heat-dissipating fan.

Figure 4:
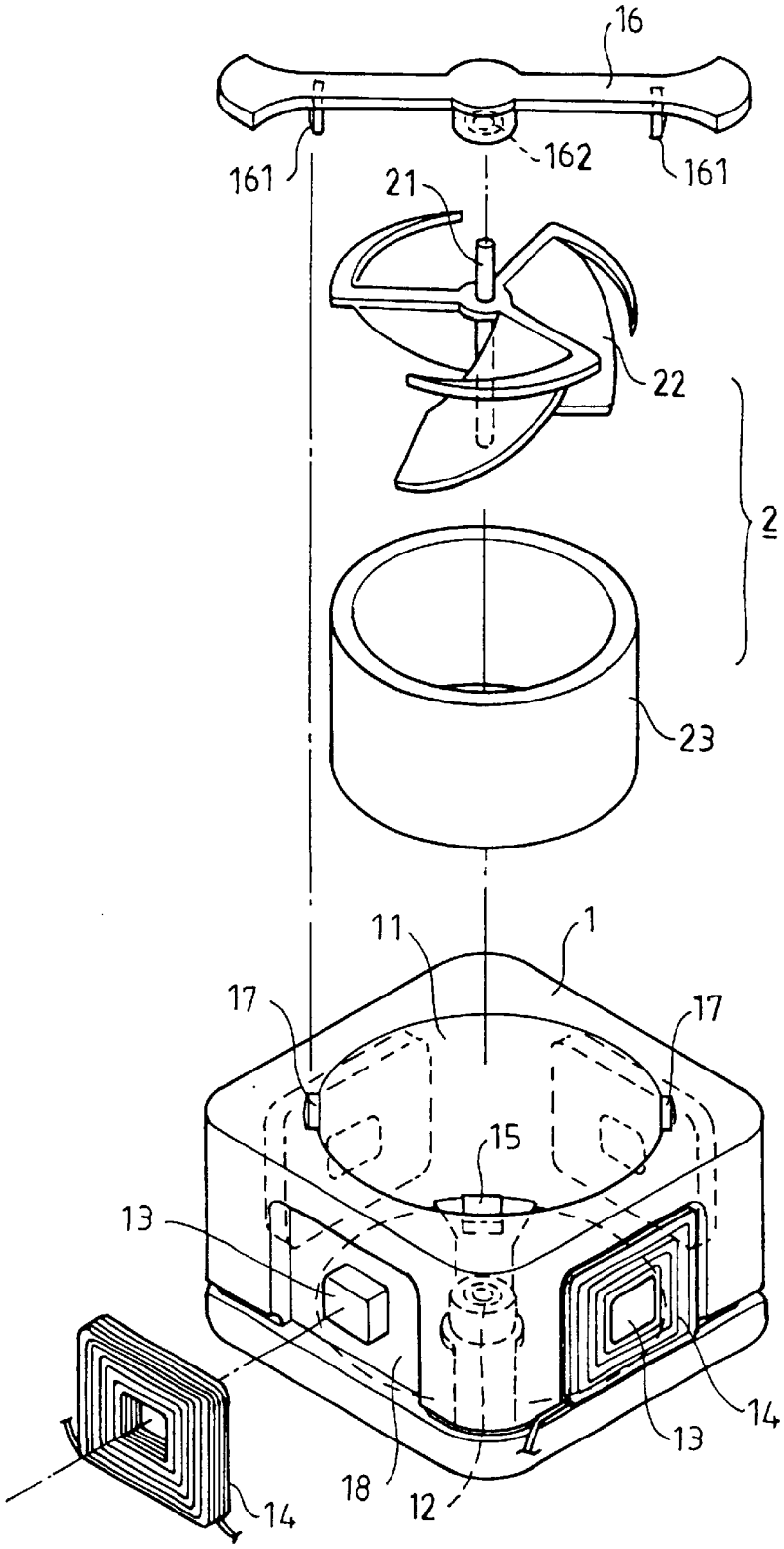
FIG. 4 is an exploded perspective view of a second embodiment of the heat-dissipating fan structure in accordance with the present invention.
Figure 5:
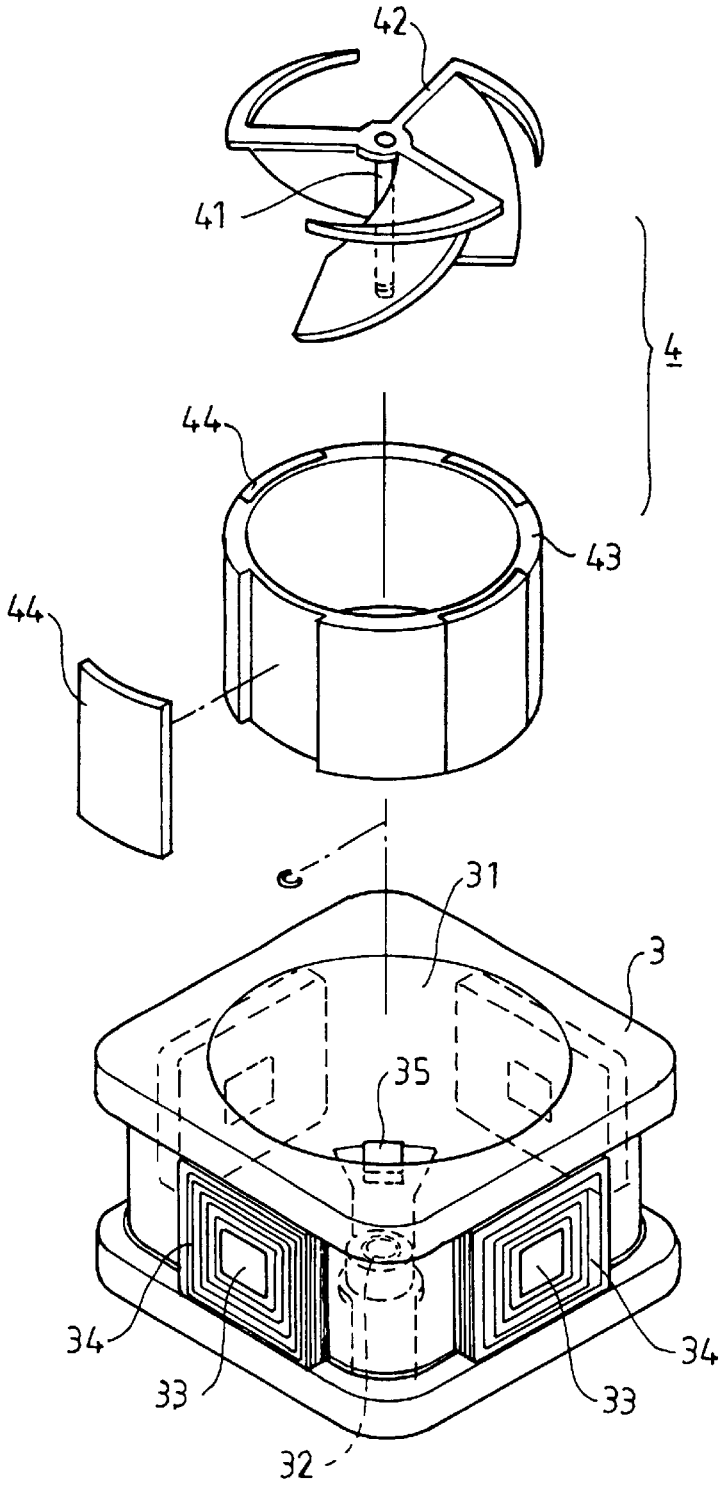
FIG. 5 is an exploded perspective view of a third embodiment of the heat-dissipating fan structure in accordance with the present invention.

FIG. 4 illustrates a second embodiment of the invention, wherein the wall of the frame 1 comprises plural countersinks 18 corresponding to the number of the windings 14. Each countersink 18 has a mounting member 13 such as an outwardly projecting peg around which an associated winding 14 is mounted and thus positioned.

The frame 1 comprises a support section 12 for rotatably holding an end of the shaft 21 of the rotor 2. Plural blades 22 and a permanent ring magnet 23 are mounted to the shaft 21. The other end of the shaft 21 is rotatably received in a support section 162 of a support element 16 that is engaged with the frame 1. In this embodiment, the support element 16 comprises engaging pieces 161 for engaging with positioning holes 17 in the frame 1. The frame 1 further comprises an IC control means 15 for detecting a change in the polarity of the permanent ring magnet 23 of the rotor 2 and sends a signal to alter the polarity of the magnetic field created by the sets of windings 14, thereby driving the permanent ring magnet 23 to turn by a repulsive force and thereby allowing continuous rotation of the rotor 2. At the same time, the blades 22 on the rotor 2 drive air to enter via an end of the through-hole 11 and to exit via the other end of the through-hole 11, thereby forming a heat-dissipating fan.

FIG. 3 illustrates a third embodiment of the invention comprising a frame 3 and a rotor 4.

The frame 3 has a through-hole 31 in which an air inlet is defined in an end of the through-hole 31 and an air outlet is defined in the other end of the through-hole 31. The frame 3 comprises a support section 32 on an end thereof, the support section 32 being in the form of a bearing or shaft sleeve for rotatably holding a shaft 41 of the rotor 4. Mounting members 33 are provided on a wall of the frame 3 for mounting a corresponding number of sets of windings 34. An IC control means 35 such as a conventional drive circuit or a Hall element is mounted on the frame 3, the IC control means 35 being electrically connected to the windings 34.

The shaft 41 is located in a central portion of the rotor 4 and has plural blades 42 provided thereon and an annular member 43 mounted around the blades 42. Even-numbered permanent magnets 44 are mounted to the annular member 43 at intervals, two adjacent permanent magnets 44 having opposite polarities.

Figure 6:
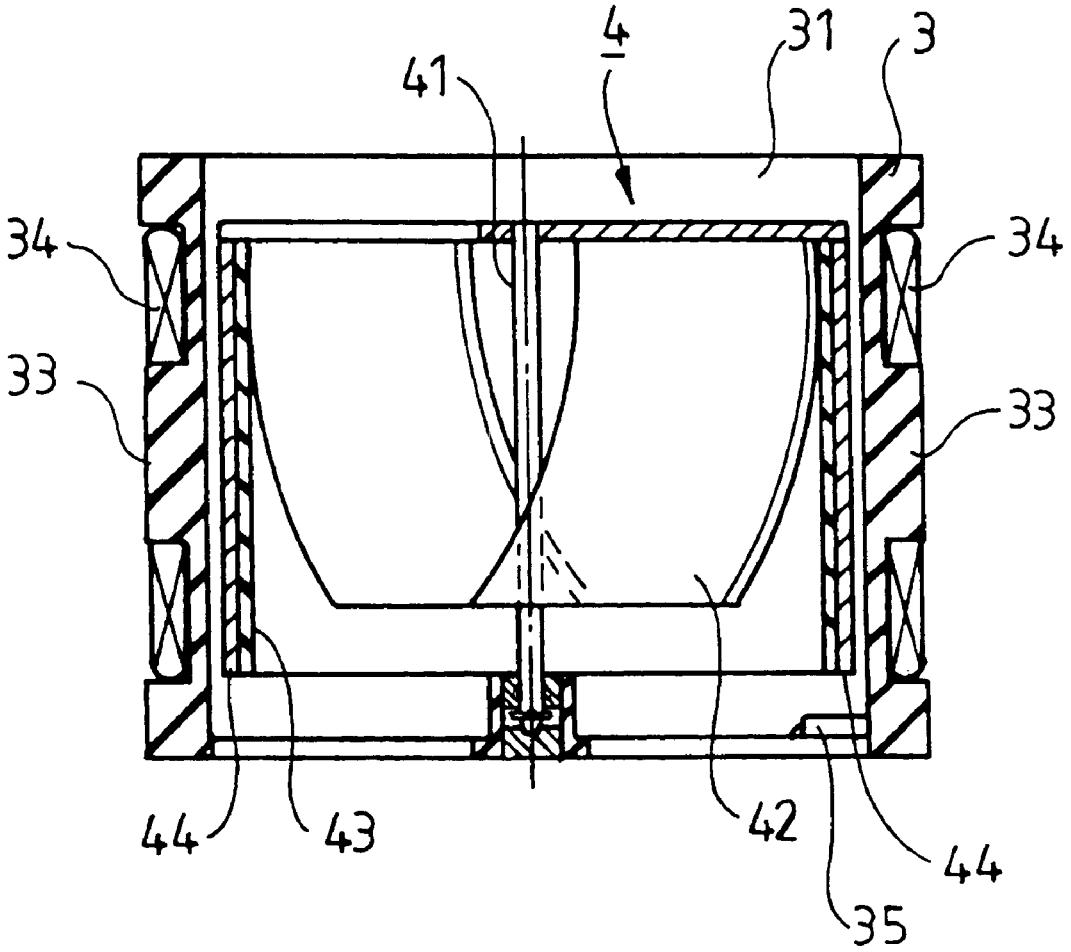
FIG. 6 is a sectional view of the heat-dissipating fan structure in FIG. 5.
Figure 7:
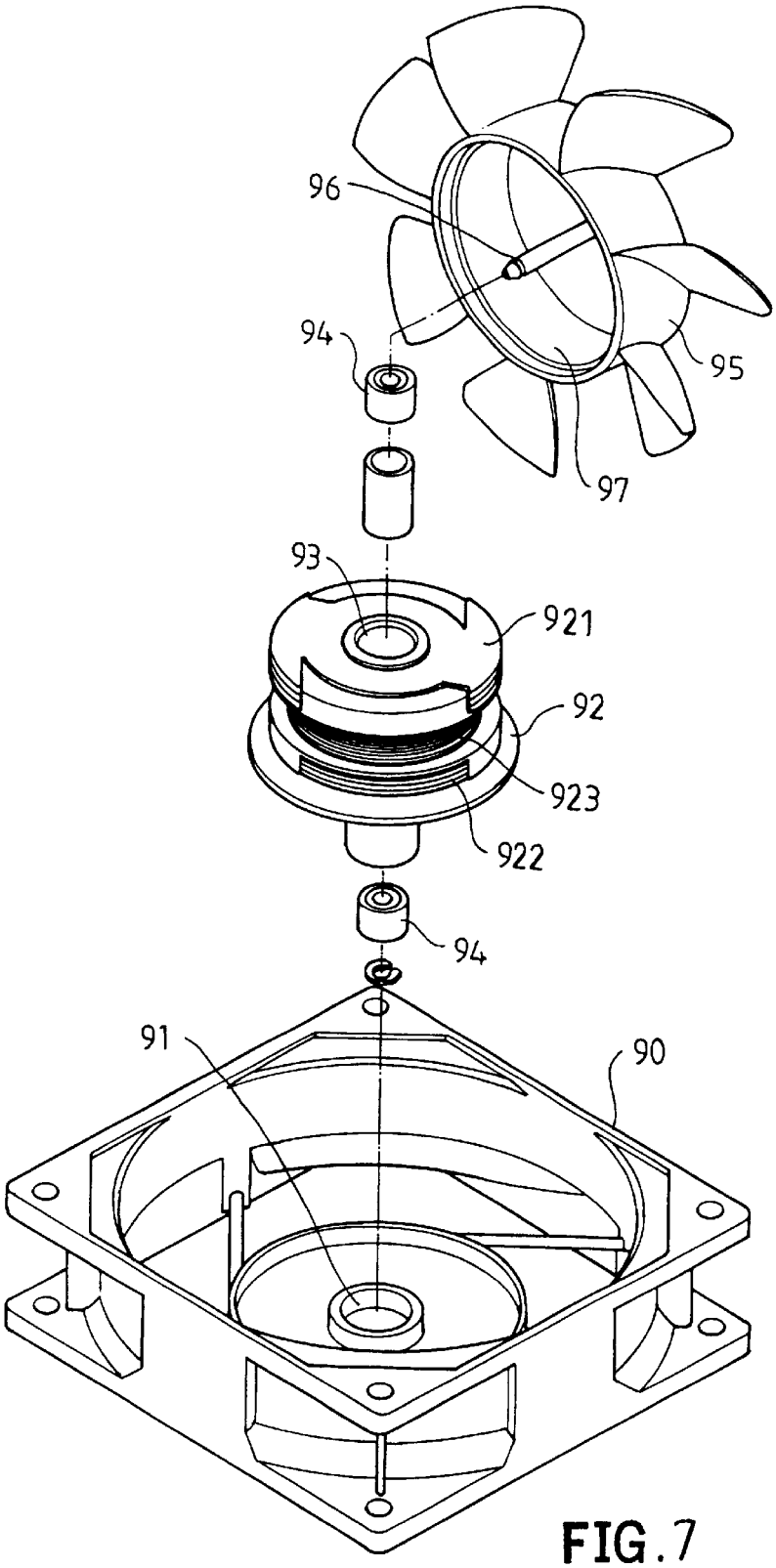
FIG. 7 PRIOR ART
FIG. 7 is an exploded perspective view of a conventional heat-dissipating fan structure.

As illustrated in FIG. 6, an end of the shaft 41 of the rotor 4 is rotatably received in the support section 32 of the frame 3, and the permanent magnets 44 of the rotor 4 are located corresponding to the positions of the windings 34 on the frame 3. Thus, the IC control means 35 detects a change in the polarity of the permanent magnets 44 of the rotor 4 and sends a signal to alter the polarity of the magnetic field created by the sets of windings 34, thereby driving the annular member 43 to which the permanent magnets 44 are mounted to turn by a repulsive force and thereby allowing continuous rotation of the rotor 4. At the same time, the blades 42 on the rotor 4 drive air to enter via an end of the through-hole 31 and to exit via the other end of the through-hole 31, thereby forming a heat-dissipating fan.

The heat-dissipating fan structure in accordance with the present invention has fewer elements and thus has a simplified structure that is easy to manufacture and process. In addition, the magnetically conductive elements such as the pole plates and the metal axle tube required in d.c. brushless motors are omitted in the heat-dissipating fan structure in accordance with the present invention. The overall volume of the heat-dissipating fan structure in accordance with the present invention is reduced. Further, since the repulsive magnetic force for turning the rotor is directly created between a magnetic field created as a result of energizing the windings and the north and south poles of the permanent magnet(s), the magnetically conductive path is largely shortened. As a result, the magnetic resistance is reduced to thereby provide the rotor with a greater rotational torque.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A heat-dissipating fan structure comprising:

a frame comprising a through-hole having two ends in which an air inlet and an air outlet are respectively defined, a support section being defined in one of the ends of the through-hole, at least two sets of windings being engaged on a wall of the frame, an IC control means being mounted on the frame and electrically connected to said at least two sets of windings;

a rotor comprising a shaft and plural blades each having an outer edge, a permanent ring magnet being engaged with the outer edges of said plural blades and having at least one north pole and at least one south pole, the shaft having an end rotatably received in the support section of the frame;

wherein the IC control means detects a change in a polarity of the permanent ring magnet of the rotor and sends a signal to alter a polarity of a magnetic field created by said at least two sets of windings, thereby driving the rotor to which the permanent ring magnet is mounted to turn by a repulsive force.

2. The heat-dissipating fan structure as claimed in claim 1, wherein the wall of the frame comprises a number of mounting members corresponding to said at least two sets of windings to thereby mount and position said at least two sets of windings, respectively.

3. The heat-dissipating fan structure as claimed in claim 2, wherein the mounting members are provided on an inner face of the wall of the frame.

4. The heat-dissipating fan structure as claimed in claim 2, wherein the mounting members are provided on an outer face of the wall of the frame.

5. The heat-dissipating fan structure as claimed in claim 2, wherein each of the mounting members is a countersink.

6. The heat-dissipating fan structure as claimed in claim 2, wherein each of the mounting members is an outwardly projecting peg.

7. The heat-dissipating fan structure as claimed in claim 1, further comprising a support element securely mounted to another end of the through-hole, the support element comprising a second support section for rotatably receiving another end of the shaft of the rotor.

8. The heat-dissipating fan structure as claimed in claim 7, wherein the support elements comprises at least one engaging piece, and wherein the frame comprises at least one positioning hole for engaging with said at least one engaging piece.

9. The heat-dissipating fan structure as claimed in claim 1, wherein the permanent ring magnet comprises an annular member and even-numbered permanent magnets mounted to the annular member at intervals.

10. The heat-dissipating fan structure as claimed in claim 9, wherein two adjacent said permanent magnets have opposite polarities.

* * * * *